US010006699B2

(12) United States Patent
Briglia et al.

(10) Patent No.: US 10,006,699 B2
(45) Date of Patent: Jun. 26, 2018

(54) METHOD FOR DENITROGENATION OF NATURAL GAS WITH OR WITHOUT HELIUM RECOVERY

(71) Applicant: L'Air Liquide, Societe Anonyme pour l'Etude et l'Exploitation des Procedes Georges Claude, Paris (FR)

(72) Inventors: Alain Briglia, Hangzhou (CN); Selim Chouik, Paris (FR)

(73) Assignee: L'AIR LIQUIDE SOCIETE ANONYME POUR L'ETUDE ET L'EXPLOITATION DES PROCEDES GEORGES CLAUDE, Paris (FR)

( * ) Notice: Subject to any disclaimer, the term of this patent is extended or adjusted under 35 U.S.C. 154(b) by 0 days. days.

(21) Appl. No.: 15/029,107

(22) PCT Filed: Oct. 14, 2014

(86) PCT No.: PCT/FR2014/052606

§ 371 (c)(1),
(2) Date: Apr. 13, 2016

(87) PCT Pub. No.: WO2015/055938

PCT Pub. Date: Apr. 23, 2015

(65) Prior Publication Data

US 2016/0245584 A1 Aug. 25, 2016

(30) Foreign Application Priority Data

Oct. 18, 2013 (FR) ..... 13 60138

(51) Int. Cl.
*F25J 3/02* (2006.01)

(52) U.S. Cl.
CPC ..... *F25J 3/0233* (2013.01); *F25J 3/0209* (2013.01); *F25J 3/0257* (2013.01);
(Continued)

(58) Field of Classification Search
CPC ..... F25J 3/0257; F25J 3/0233; F25J 3/066; F25J 2210/42; F25J 2220/44
See application file for complete search history.

(56) References Cited

U.S. PATENT DOCUMENTS 2,557,171 A 6/1951 Bodle et al.
4,331,461 A * 5/1982 Karbosky ..... C07C 7/00 62/630

(Continued)

FOREIGN PATENT DOCUMENTS

DE 102 15 125 10/2003
DE 20 2009 010874 11/2009

(Continued)

OTHER PUBLICATIONS

International Search Report and Written Opinion for PCT/FR2014/052606, dated Oct. 22, 2015.

(Continued)

*Primary Examiner* — Brian King
(74) *Attorney, Agent, or Firm* — Justin K. Murray

(57) ABSTRACT

The invention relates to a method for denitrogenation of natural gas by distillation, in which natural gas cooled in an exchange line is separated in a system of columns including at least one column, a nitrogen-enriched gas is drawn from one column of the system of columns and is heated in the exchange line, a methane-enriched liquid is drawn from one column of the system of columns, pressurized and vaporized in the exchange line at at least one vaporization pressure, and at least one portion of the cooled natural gas expands in gaseous form in a turbine and is sent to one column of the system of columns in gaseous form.

12 Claims, 3 Drawing Sheets

(52) U.S. Cl.
CPC ..... *F25J 2200/06* (2013.01); *F25J 2230/08* (2013.01); *F25J 2230/60* (2013.01); *F25J 2235/60* (2013.01); *F25J 2240/02* (2013.01); *F25J 2240/40* (2013.01)

(56) References Cited

U.S. PATENT DOCUMENTS

| | | | | | |
|---|---|---|---|---|---|
| 4,357,153 | A | | 11/1982 | Erickson | |
| 4,758,258 | A | | 7/1988 | Mitchell et al. | |
| 4,778,498 | A | | 10/1988 | Hanson et al. | |
| 4,936,888 | A | * | 6/1990 | DeLong | F25J 3/0209 62/622 |
| 4,948,405 | A | * | 8/1990 | Thompson | F25J 3/0209 62/630 |
| 5,692,395 | A | * | 12/1997 | Agrawal | B01D 3/146 62/630 |
| 2004/0103687 | A1 | * | 6/2004 | Clare | F25J 3/0209 62/621 |
| 2012/0017640 | A1 | * | 1/2012 | Bauer | F25J 3/0209 62/620 |
| 2012/0090355 | A1 | * | 4/2012 | Johnson | F25J 3/0209 62/618 |
| 2014/0060114 | A1 | * | 3/2014 | Mak | F25J 3/0209 62/630 |

FOREIGN PATENT DOCUMENTS

| | | |
|---|---|---|
| EP | 1 426 717 | 6/2004 |
| JP | S54 20986 | 2/1979 |

OTHER PUBLICATIONS

Streich, M., "Nitrogen Removal from Natural Gas." ICR12, Madrid, 167, pp. 223 and 236 only.

* cited by examiner

METHOD FOR DENITROGENATION OF NATURAL GAS WITH OR WITHOUT HELIUM RECOVERY

CROSS REFERENCE TO RELATED APPLICATIONS

This application is a § 371 of International PCT Application PCT/FR2014/052606, filed Oct. 14, 2014, which claims the benefit of FR1360138, filed Oct. 18, 2013, both of which are herein incorporated by reference in their entireties.

TECHNICAL FIELD OF THE INVENTION

The present invention relates to methods for removing nitrogen from natural gas with or without the recovery of helium.

BACKGROUND OF THE INVENTION

The natural gas deposits being exploited contain increasing quantities of nitrogen. This is notably because fields that are rich enough for no enrichment treatment to be needed before the gas is commercialized are becoming exhausted and increasingly rare.

These sources of natural gas often also contain helium. The latter can be put to commercial use by performing a pre-concentration before final treatment and liquefaction.

Unconventional resources such as shale gas deposits also share the same problem set: in order to make them commercially viable, it may prove necessary to increase their calorific value by means of a pretreatment that involves removing nitrogen from the raw gas.

U.S. Pat. No. 4,778,498 describes a double column used for a denitrogenization of natural gas.

M. Streich's "Nitrogen Removal from Natural Gas" presented at the ICR12 in Madrid in 1967 explains how to use a turbine to expand the natural gas that is to be separated in a double denitrogenization column.

Units for the removal of nitrogen from natural gas generally treat gases which come directly from wells at a high pressure. After the removal of nitrogen, the treated gas needs to be returned to the network, often at a pressure close to the pressure at which it entered it.

The removal of nitrogen from natural gas in most instances calls for cryogenic distillation techniques which take place at pressures lower than the pressures of the sources. For example, the sources may be at pressures of the order of 60 to 80 bara, whereas cryogenic separation is performed at pressures varying from 30 bara to a pressure slightly higher than atmospheric pressure. In general, the natural gas purified of its nitrogen is produced at low pressure and it needs to be pumped and/or compressed in order to introduce it into the network.

In order to adapt the thermal and energy balance sheets and minimize the operating costs of the unit, the natural gas purified of nitrogen may be produced at different pressure levels as it leaves the cold box. The various streams are then compressed by external compression until they reach the desired pressure.

In addition, distillation at pressures in excess of 12 bara is generally ill suited to the use of structured packing because of "washer" phenomena associated with the fact that the densities of the gases and liquids passing through the columns are very closely spaced, entailing the use of trays for these pressure levels.

SUMMARY OF THE INVENTION

Embodiments of the invention may include harnessing the expansion of the natural gas in the various process turbines, using it in particular to perform the cold compression. This may be the compression of the product (typically natural gas purified of nitrogen) and/or the compression of a fluid internal to the process. For example, the compression of the gas at the top of the high-pressure column of a double column process means that the pressure of this column can be reduced.

Such a method may notably make it possible to:

- improve operating costs by optimizing energy consumption;
- reducing investment;
- improve distillation;
- and if applicable, improve the efficiency with which helium is extracted.

One subject matter of the invention provides a method for the removal of nitrogen from natural gas by distillation, in which:

i) natural gas cooled in an exchange line is separated in a system of columns comprising at least one column, ii) a nitrogen-enriched gas is withdrawn from one column of the system of columns and heats up in the exchange line, iii) a methane-enriched liquid is withdrawn from one column of the system of columns, pressurized and vaporized in the exchange line to at least an evaporating pressure, and at least part of the cooled natural gas expands in gaseous form in a turbine and is sent to a column of the system of columns in gaseous form, wherein the methane-enriched liquid is vaporized at at least two pressures, or even three.

According to other optional subject matters:

- a second part of the natural gas condenses at least partially and is sent in at least partially condensed form to one column of the system of columns.
- the methane-enriched liquid withdrawn from one column of the system is fully or partially pumped at one or more pressure level(s) before being vaporized in the exchange line.
- the previously pumped methane-enriched liquid is split into at least two fractions of which at least one is expanded in a valve before vaporizing in the exchange line.
- the energy supplied by the turbine is harnessed in at least one compressor which compresses a process gas, the compressor having an inlet temperature lower than the ambient temperature, or even lower than −150° C.
- the compressor is directly driven by the turbine.
- the process gas is natural gas intended to be separated, a gas produced by distillation, for example the nitrogen-enriched gas or a gas used to transfer heat from one column of the system to another.
- the process gas is produced by vaporizing the methane-enriched liquid in the exchange line.
- the process gas is withdrawn from the exchange line in order to be compressed in the compressor and is then possibly sent back to the exchange line.
- the process gas is a nitrogen-enriched gas coming from one column of the system of columns and which is compressed in the compressor and then used to heat the bottom of another column of the system.
- the system comprises a first column operating at a first pressure, a second column operating at a second pressure lower than the first pressure, the second column being thermally connected to the first column, the natural gas being sent to the first column to produce a bottom liquid and a head gas, at least part of the bottom liquid is sent to the second column, at least part of the head gas being used to heat the bottom of the second column, the nitrogen-enriched gas is withdrawn from the top of the second column and the methane-enriched liquid is withdrawn from the bottom of the second column and the gas expanded in the turbine is sent to the first column in gaseous form.

an intermediate liquid for the first column is expanded and sent to the second column at an intermediate level or at the top level.

between 1 and 80% of the gas that is to be separated, preferably between 5 and 55% or even between 25 and 35% of the gas that is to be separated is expanded in gaseous form in the expansion turbine.

the at least one part of the natural gas coded in the heat exchanger and sent to the turbine remains gaseous as it cools upstream of the turbine.

the part of natural gas intended for the turbine is withdrawn at an intermediate level of the heat exchanger.

the second part of the natural gas cools as far as the cold end of the heat exchanger.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1:
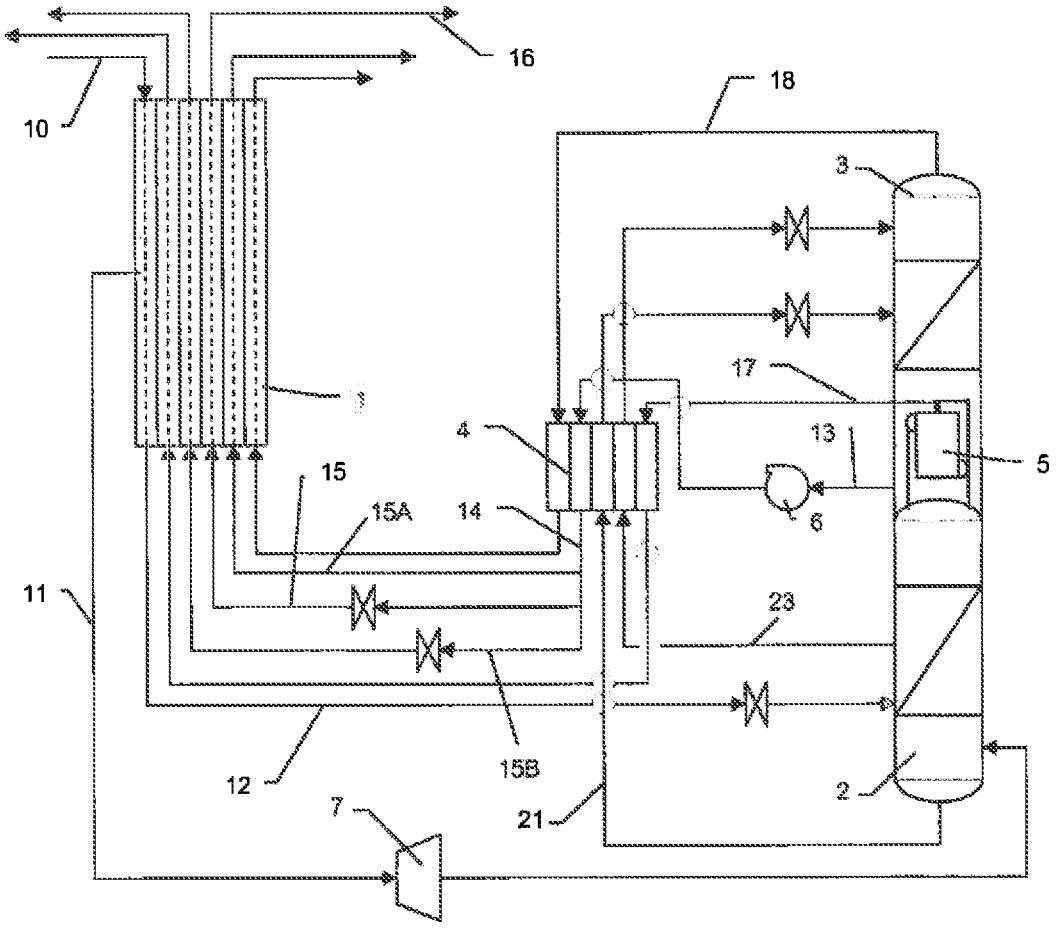
FIG. 1 represents a process flow diagram in accordance with an embodiment of the present invention.

The invention will be described in greater detail with reference to the figures which illustrate methods according to the invention.

In all cases, the method is carried out in an insulated cold box containing an exchange line 1 and a double column 2, 3 comprising a first column 2 operating at between 10 and 30 bara and a second column 3 operating at between 0.8 and 3 bara. The first column 2 is thermally connected to the second column 3 by means of a vaporizer-condenser 5. The exchange line comprises at least one heat exchanger, preferably a plate and fin brazed aluminum heat exchanger.

In all the figures, the natural gas 10, which is generally at a pressure in excess of 35 bara, is cooled in the exchange line 1. At an intermediate temperature thereof, a part 11 of the natural gas, representing between 1 and 80% of the gas to be separated, preferably between 5 and 55%, or even between 25 and 35% of the gas that is to be separated, is withdrawn from the exchange line 1 and expanded in gaseous form in an expansion turbine 7 which produces a fluid which is sent to the bottom of the first column where it separates. The rest of the natural gas 12 continues to be cooled in the exchange line wherein it is condensed and is then expanded in an expansion valve before being sent in liquid form to the first column. Fed with these two fluids, the column 2 separates the natural gas into a methane-enriched liquid 21 at the bottom of the column and a nitrogen-enriched gas at the top of the column. The gas is used to warm up the vaporizer-condenser 5 where it condenses ensuring reflux at the top of the column 2. The bottom liquid cools in a subcooler 4 and is expanded to be sent to an intermediate level of the second column 3. An intermediate liquid 23 of the first column 2 is subcooled, expanded and sent to the top of the second column 23.

The residual nitrogen 18 is withdrawn from the top of the column and heats up in the exchangers 4, 1.

Incondensable gases enriched with helium and nitrogen 17 leave the vaporizer 5 and warm up in the exchangers 4, 1.

In FIG. 1, the methane-enriched liquid 13 of the second column 3 is withdrawn from the bottom, pumped at high pressure by means of the pump 6, subcooled and then split like the flow 14 into three fractions. One fraction 15A vaporizes in the exchange line 1 at the outlet pressure of the pump 6. The fractions 15, 15B are expanded at different pressures from one another by valves and each vaporizes in the exchange line at a different evaporating pressure. The fraction 15 leaves the exchange line as a gaseous flow 16.

Figure 2:
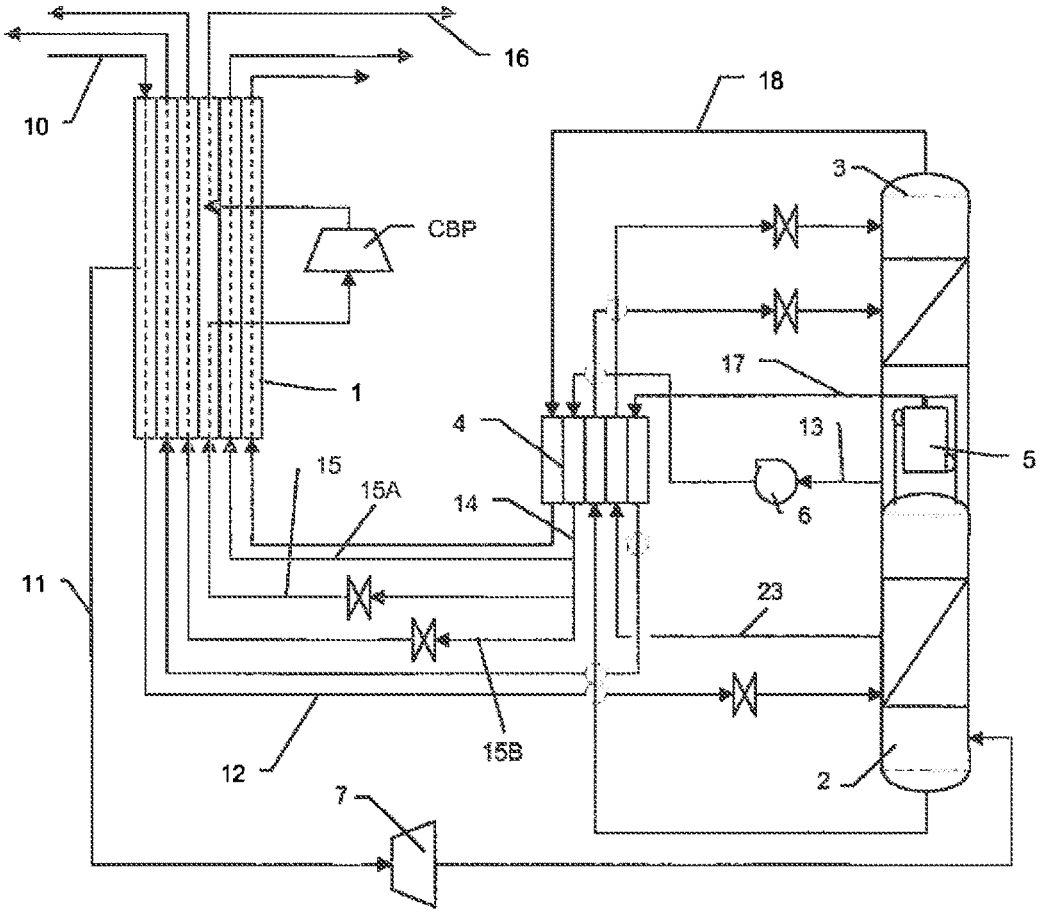
FIG. 2 represents a process flow diagram in accordance with an alternate embodiment of the present invention.

In FIG. 2, the liquid 14 is split in the same way but the liquid 15 vaporizes in the exchange line 1, leaves the latter, is compressed cold in a booster compressor CBP before being sent back into the exchange line 1 to continue heating up. This booster compressor CBP harnesses the energy of the turbine 7.

Figure 3:
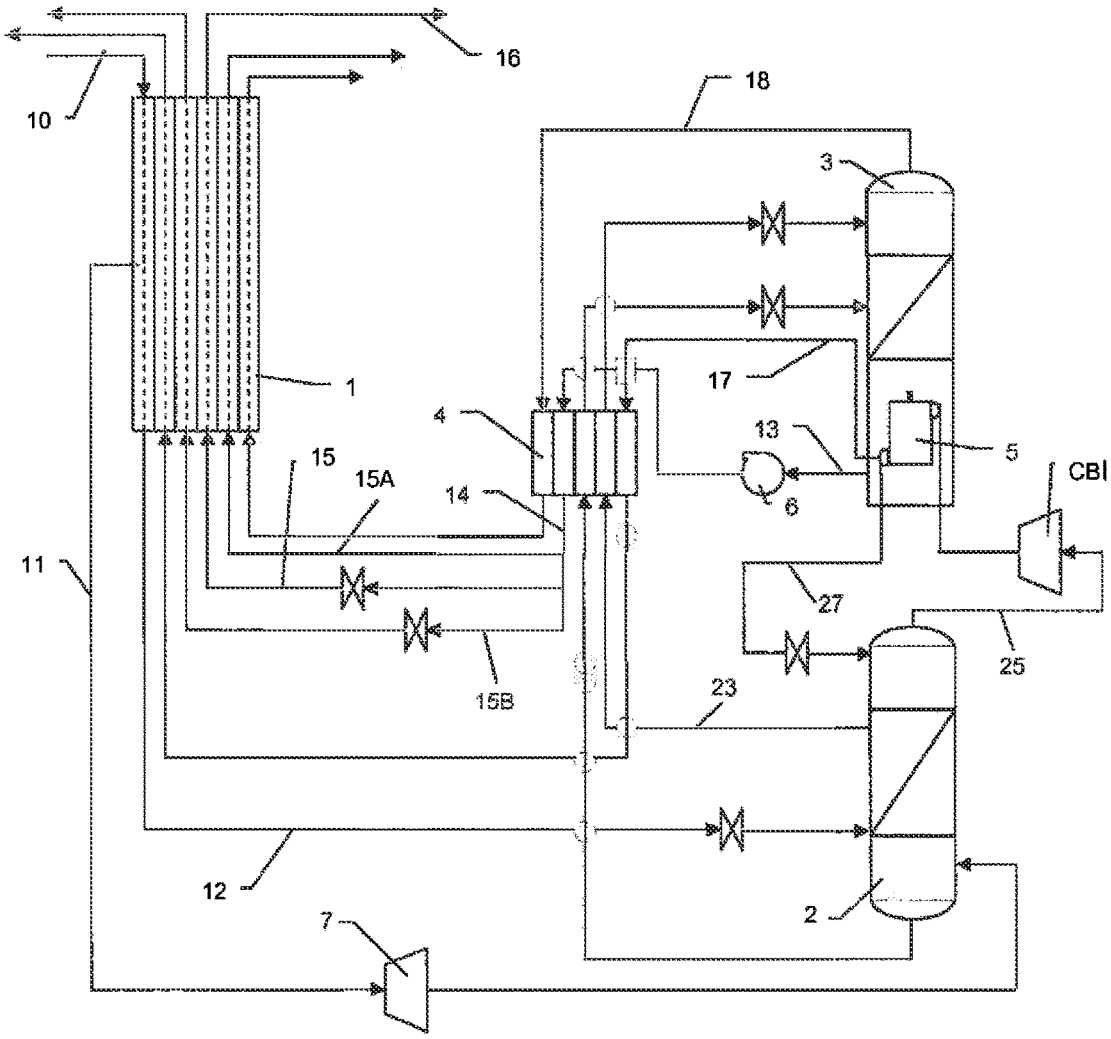
FIG. 3 represents a process flow diagram in accordance with another embodiment of the present invention.

In FIG. 3, the liquids produced by the splitting of the liquid 14 vaporize in the same way as in FIG. 1. By contrast, the nitrogen-enriched gas 25 at the top of the first column 2 is compressed to a pressure of 17 to 30 bara in a cold booster compressor CBI that has an inlet temperature generally of below −150° C. The compressed nitrogen is used to heat the vaporizer 5 where it condenses into a fluid 27, is expanded in a valve and sent back to the top of the column 2.

The first and second columns may be replaced by a single column.

Equipment:

1 Main exchange line, 2 First column, high pressure, 3 Second column, low pressure 4 Subcooler, 5 vaporizer-condenser, 6 Methane pump, 7 Expansion turbine. CBP production cold booster compressor; CBI Internal fluid cold booster compressor Fluids:

10 Natural gas to be treated, 11 Natural gas to be treated heading toward turbine, 12 Natural gas to be treated heading toward expansion, 13 Low-pressure liquid methane, 14 High-pressure liquid methane, 15 Medium-pressure liquid methane, 16 Medium-pressure gaseous methane, 17 Mixture of nitrogen and helium, 18 Residual nitrogen.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A method for the removal of nitrogen from natural gas by distillation, the method comprising the steps of:

i) cooling natural gas in an exchange line and then separating said cooled natural gas in a system of columns, wherein the system of columns comprises a first column operating at a first pressure, a second column operating at a second pressure lower than the first pressure, the second column being thermally connected to the first column, the natural gas being sent to the first column to produce a bottom liquid and a head gas, at least part of the enriched bottom liquid is sent to the second column, at least part of the head gas being used to heat the bottom of the second column;

ii) withdrawing a nitrogen-enriched gas from the second column and then heating said nitrogen-enriched gas in the exchange line;

iii) withdrawing a methane-enriched liquid from the second column, and then pressurizing the methane-enriched liquid to form a pressurized methane-rich liquid;

iv) splitting the pressurized methane-rich into at least a first fraction and a second fraction, wherein the first fraction is at a first fraction pressure ($P_1$);

v) expanding the second fraction to a second expanded pressure ($P_2$), wherein the $P_2$ is less than the $P_1$;

vi) vaporizing the first fraction and the second fraction within the exchange line to form a gaseous first fraction and a gaseous second fraction, wherein the first fraction vaporizes at the $P_1$ and the second fraction vaporizes at the $P_2$; and vii) using a nitrogen-enriched gas from the top portion of the first column as a reboiling fluid for the vaporizer-condenser;

wherein at least part of the cooled natural gas expands in gaseous form in a turbine and is sent to the first column in gaseous form, wherein energy supplied by the turbine is harnessed in at least one compressor which compresses a process gas, wherein the process gas is selected from the group consisting of the nitrogen-enriched gas from the top portion of the first column, the gaseous second fraction withdrawn from an intermediate location of the exchange line, and combinations thereof wherein the process gas is the gaseous second fraction withdrawn from an intermediate location of the exchange line and in order to be compressed in the at least one compressor and is then sent back to the exchange line for further warming therein.

2. The method as claimed in claim 1, the at least part of the cooled natural gas is a first part of the cooled natural gas and the cooled natural gas further comprises a second part of the cooled natural gas which condenses at least partially and is sent in at least partially condensed form to first column.

3. The method as claimed in claim 1, wherein the at least one compressor which compresses the process gas has an inlet temperature lower than −150° C.

4. The method as claimed in claim 3, wherein the at least one compressor is directly driven by the turbine.

5. The method as claimed in claim 1, wherein an intermediate liquid withdrawn from the first column is expanded and sent to the second column at an intermediate level or at the top level.

6. The method as claimed in claim 1, wherein the at least part of the natural gas cooled in the exchange line and sent to the turbine remains gaseous as the at least part of the natural gas cooled in the exchange line cools upstream of the turbine.

7. The method as claimed in claim 1, wherein the at least part of the cooled natural gas intended for the turbine is withdrawn at an intermediate level of the exchange line.

8. The method as claimed in claim 2, wherein the second part of the natural gas cools as far as the cold and of the exchange line.

9. A method for denitrogenation of a natural gas stream, the method comprising the steps of:

providing an insulated cold box having a system of columns and an exchange line disposed within, wherein the system of columns comprises a higher pressure column and a lower pressure column, wherein the higher pressure column operates at a high pressure between 10 and 30 bara, wherein the lower pressure column operates at a low pressure between 0.8 and 3 bara, wherein the lower pressure column and the higher pressure column are thermally connected via a vaporizer-condenser, introducing the natural gas stream into the insulated cold box at a pressure above the high pressure and cooling the natural gas stream within the exchange line;

expanding a first portion of the cooled natural gas stream in a turbine and then sending the expanded first portion of the natural gas stream to the higher pressure column for separation therein;

condensing a second portion of the natural gas stream in the exchange line and then expanding the condensed second portion of the natural gas stream in an expansion valve before being sent in liquid form to the higher pressure column for separation therein;

producing a methane-enriched liquid at a bottom portion of the higher pressure column and a nitrogen-enriched gas at a top portion of the higher pressure column;

using the nitrogen-enriched gas from the top portion of the higher pressure column as a reboiling fluid for the vaporizer-condenser, withdrawing the methane-enriched liquid from the higher pressure column and introducing the methane-enriched liquid to the lower pressure column after expansion in a second expansion valve;

producing a methane-rich liquid at a bottom portion of the lower pressure column and a residual nitrogen gas at a top portion of the lower pressure column;

withdrawing the methane-rich liquid from the lower pressure column and increasing the pressure of the methane-rich liquid using a pump to form a pressurized methane-rich liquid;

splitting the pressurized methane-rich liquid into at least a first fraction and a second fraction, wherein the first fraction is at a first fraction pressure ($P_1$);

expanding the second fraction in a third expansion valve to a second expanded pressure ($P_2$), wherein the $P_2$ is less than the $P_1$; and vaporizing the first fraction and the second fraction within the exchange line to form a gaseous first fraction and a gaseous second fraction, wherein the first fraction vaporizes at the $P_1$ and the second fraction vaporizes at the $P_2$, wherein energy supplied by the turbine is harnessed in a cold compressor which compresses a process gas at a temperature below that of a warm end of the exchange line, wherein the process gas is selected from the group consisting of the nitrogen-enriched gas from the top portion of the first column, the gaseous second fraction after being withdrawn from an intermediate location of the exchange line, and combinations thereof further comprising the step of withdrawing the gaseous second fraction from an intermediate location of the exchange line and compressing the gaseous second fraction in a cold booster to form a boosted second fraction, and then reintroducing the boosted second fraction into the exchange line for further warming within the exchange line.

10. The method as claimed in claim 9, wherein the step of splitting the pressurized methane-rich liquid further includes a third fraction, wherein the method further includes the steps of:

expanding the third fraction in a fourth expansion valve to a third expanded pressure ($P_3$), wherein the $P_3$ is less than the $P_1$, wherein the $P_3$ is different than the $P_2$; and vaporizing the third fraction within the exchange line, wherein the third fraction vaporizes at the $P_3$.

11. The method as claimed in claim 9, wherein the step of using the nitrogen-enriched gas from the top portion of the higher pressure column as a reboiling fluid for the vaporizer-condenser further comprises the steps of:

withdrawing the nitrogen-enriched gas from the top portion of the higher pressure column;

compressing the nitrogen-enriched gas in a nitrogen cold booster to a pressure exceeding the high pressure to form a boosted nitrogen-enriched gas;

condensing a portion of the nitrogen-enriched gas in the vaporizer-condenser to form a condensed nitrogen-enriched fluid; and expanding the condensed nitrogen-enriched fluid in a nitrogen expansion valve and introducing the expanded nitrogen-enriched fluid into a top portion of the higher pressure column.

12. The method as claimed in claim 11, wherein the nitrogen cold booster receives the nitrogen-enriched gas at a temperature at or below −150° C.

* * * * *